US010516238B2

(12) United States Patent
Lee et al.

(10) Patent No.: US 10,516,238 B2
(45) Date of Patent: Dec. 24, 2019

(54) METHOD FOR FORMING A SHIELDED ELECTRICAL TERMINAL AND AN ELECTRICAL TERMINAL FORMED BY SAID METHOD

(71) Applicant: Delphi Technologies, LLC, Troy, MI (US)

(72) Inventors: Joon Lee, Carmel, IN (US); Dominic Anthony Messuri, Canfield, OH (US); Christopher Adrian Margrave, Ashtabula, OH (US); Michael Jerry Demonica, Cortland, OH (US); John R. Morello, Warren, OH (US)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/997,772

(22) Filed: Jun. 5, 2018

(65) Prior Publication Data

US 2018/0358757 A1 Dec. 13, 2018

Related U.S. Application Data

(60) Provisional application No. 62/516,866, filed on Jun. 8, 2017.

(51) Int. Cl.

| | |
|---|---|
| ***H01R 13/6591*** | (2011.01) |
| ***H01R 13/6581*** | (2011.01) |
| ***H01R 13/11*** | (2006.01) |
| ***H01R 43/16*** | (2006.01) |
| ***H01R 43/00*** | (2006.01) |

(Continued)

(52) U.S. Cl.

CPC ..... *H01R 13/6591* (2013.01); *H01R 13/111* (2013.01); *H01R 13/6581* (2013.01); *H01R 43/16* (2013.01); *H01R 4/185* (2013.01); *H01R 24/40* (2013.01); *H01R 43/00* (2013.01)

(58) Field of Classification Search

CPC .... H01R 13/111; H01R 13/187; H01R 43/16; H01R 13/193; H01R 4/4881; H01R 13/11; H01R 12/58; H01R 13/18; H01R 13/33

USPC ..... 439/843, 851, 852, 125, 578, 748, 750, 439/752, 80, 839, 844, 845, 856

See application file for complete search history.

(56) References Cited

U.S. PATENT DOCUMENTS 4,550,972 A * 11/1985 Romak ..... H01R 13/111 439/839

4,951,389 A * 8/1990 Kaley ..... H01R 43/16 29/863

(Continued)

*Primary Examiner* — Edwin A. Leon
*Assistant Examiner* — Matthew T Dzierzynski
(74) *Attorney, Agent, or Firm* — Robert J. Myers

(57) ABSTRACT

A method of forming a shielded electrical terminal configured to receive a corresponding shielded electrical terminal. The terminal includes an inner shield defining a shield cavity about a longitudinal axis. The shield cavity is configured to receive the corresponding shielded electrical terminal. The inner shield has a longitudinal inner seam substantially that is parallel to the longitudinal axis. The inner shield defines a plurality of resilient contact springs that protrude into the shield cavity. The contact springs are configured to contact the corresponding shielded electrical terminal. The terminal also includes an outer shield integrally formed with the inner shield and covering at least a portion of the inner shield. The terminal formed by this method is also presented.

29 Claims, 5 Drawing Sheets

(51) Int. Cl.
*H01R 24/40* (2011.01)
*H01R 4/18* (2006.01)

(56) References Cited

U.S. PATENT DOCUMENTS 5,033,982 A * 7/1991 Lucas ..... H01R 13/53 439/125
5,658,175 A * 8/1997 Muzslay ..... H01R 13/111 29/874
5,720,634 A * 2/1998 Sten ..... H01R 13/111 439/843
5,807,120 A * 9/1998 Matthews ..... H01R 12/58 439/748
5,921,822 A * 7/1999 Kennedy ..... H01R 13/187 439/851
6,358,104 B2 * 3/2002 Daugherty ..... H01R 13/111 439/851
6,482,049 B1 * 11/2002 Swearingen ..... H01R 4/4881 439/843
6,860,768 B2 * 3/2005 Zhao ..... H01R 11/22 439/843
6,899,571 B1 * 5/2005 Koch ..... H01R 4/4881 439/843
7,048,596 B2 * 5/2006 Swearingen ..... H01R 4/4881 439/843
7,252,559 B1 8/2007 Morello et al.
7,387,549 B1 * 6/2008 Hung ..... H01R 13/111 439/851
8,622,774 B2 1/2014 Seifert et al.
8,731,671 B2 * 5/2014 Rodby ..... A61N 1/3752 439/843
9,455,514 B2 * 9/2016 Hirakawa ..... H01R 13/02
9,748,685 B2 * 8/2017 Oba ..... H01R 4/023
2004/0180577 A1 9/2004 Zhang
2006/0160417 A1 7/2006 Montena
2009/0023339 A1 1/2009 Kameyama et al.
2009/0318025 A1 12/2009 Kameyama
2012/0040555 A1 * 2/2012 Shih ..... H01R 13/111 439/578
2014/0094052 A1 4/2014 Ozaki et al.

* cited by examiner

METHOD FOR FORMING A SHIELDED ELECTRICAL TERMINAL AND AN ELECTRICAL TERMINAL FORMED BY SAID METHOD

CROSS-REFERENCE TO RELATED APPLICATION

This application claims the benefit under 35 USC § 119(e) of U.S. Provisional Patent Application No. 62/516,866 filed on Jun. 8, 2017, the entire disclosure of which is hereby incorporated by reference.

TECHNICAL FIELD OF THE INVENTION

The invention generally relates to coaxial connector assemblies, particularly a method of forming a shielded electrical terminal and a shielded electrical terminal formed by this method.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

The problem of leakage of the electrical field from a shielded electrical terminal is solved by forming an inner shield that defines a plurality of contact springs and forming an outer shield over the inner shield that at least covers the openings in the inner shield associated with the contact springs.

In the following description, orientation terms such as "longitudinal" will refer to the mating axis X while "lateral" refers to an axis perpendicular to the mating axis, which is not necessarily the transverse axis. Furthermore, terms relating to "top" "bottom", "upper", and "lower" are to be understood relative to an axis perpendicular to the mating axis X, which is not necessarily the vertical axis. As used herein the terms "front" and "forward" refer to a lateral orientation from the first connector towards the second connector and the terms "back", "rear", "rearward", and "behind" refer to a lateral orientation oriented from the second connector towards the first connector.

Figure 1:
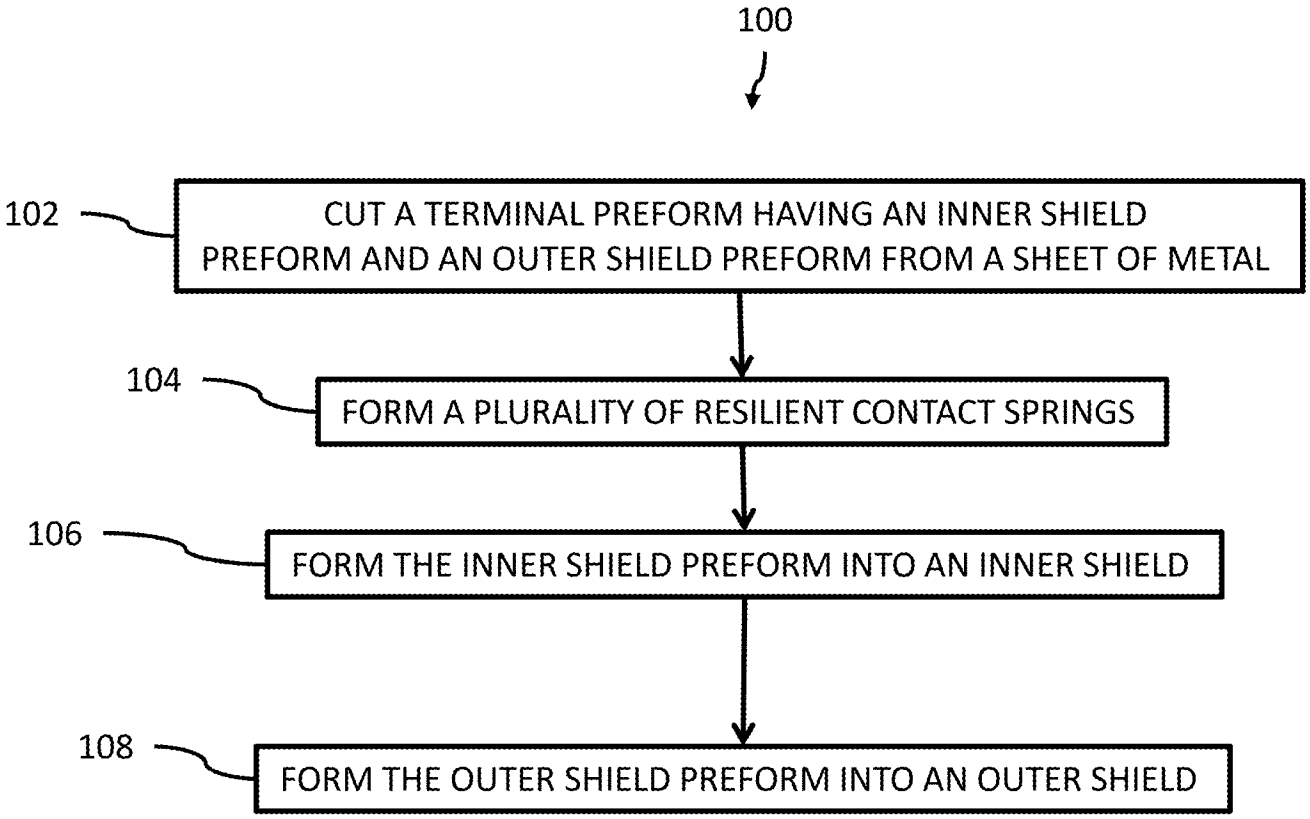
FIG. 1 is a flow chart of a method of forming a shielded electrical terminal configured to receive a corresponding shielded electrical terminal according to an embodiment of the invention.
Figure 2:
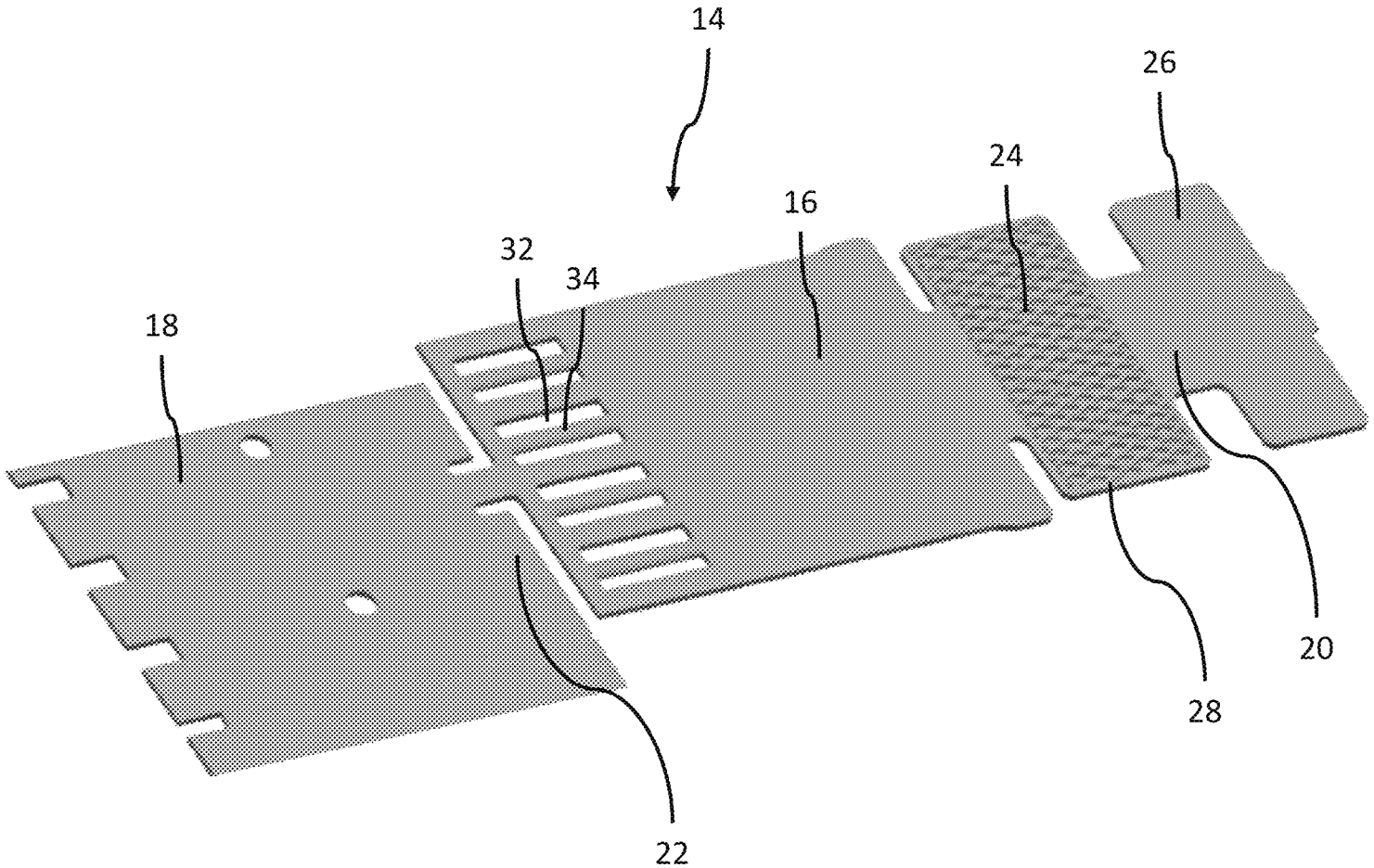
FIG. 2 is a perspective view of a terminal preform according to an embodiment of the invention.

FIGS. 1 through 5 illustrate a method 100 of forming a female shield terminal 10 configured to receive a corresponding male shield terminal 12 according to one embodiment of the invention. The method 100 includes the following steps:

STEP 102, CUT A TERMINAL PREFORM HAVING AN INNER SHIELD PREFORM AND AN OUTER SHIELD PREFORM FROM A SHEET OF METAL, includes cutting a terminal preform 14 from a sheet of metal (not shown), such as a copper alloy, defining a single plane, as illustrated in FIG. 2. The terminal preform 14 may be cut from the metal sheet using known techniques such as stamping, blanking, and water jet or laser cutting. The terminal preform 14 has an inner shield preform portion 16, an outer shield preform portion 18, and a connection preform 20. The inner shield preform portion 16, the outer shield preform portion 18, and the connection preform 20 are integrally formed. The inner shield preform portion 16 is connected to the outer shield preform portion 18 by a narrowed connecting strip 22. The connection preform 20 includes a pair of shield crimp wings 24 configured to contact the shield of a shielded coaxial cable (not shown) and a pair of insulation crimp wings 26 configured to secure the female shield terminal 10 to the coaxial cable. The shield crimp wings 24 define a knurled pattern 28 to reduce connection resistance between the female shield terminal 10 and the shield.

Figure 3:
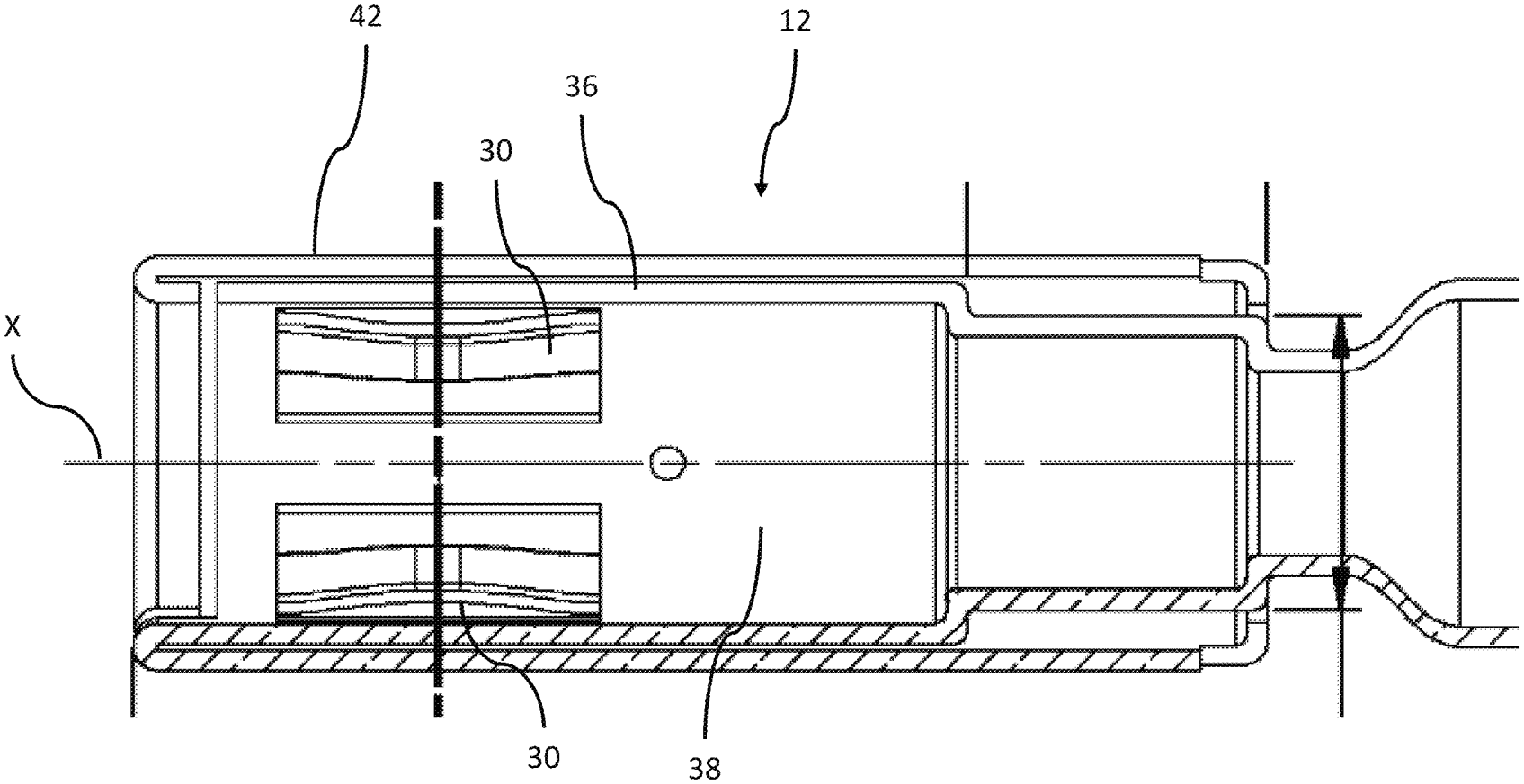
FIG. 3 is a cross section side view of a shielded electrical terminal formed from the terminal preform of FIG. 2 according to an embodiment of the invention.
Figure 4B:
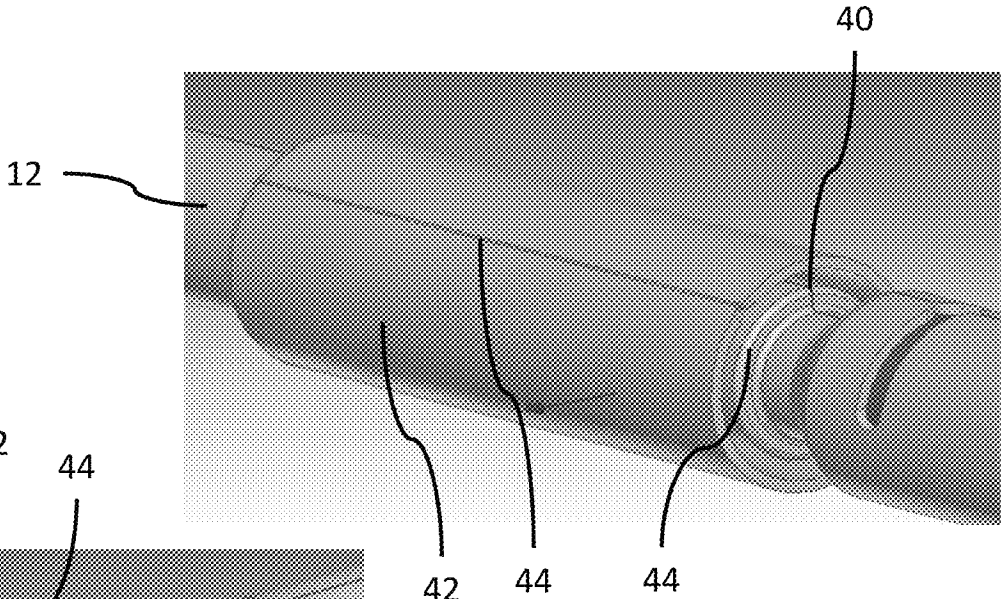
FIG. 4B is an alternate perspective view of the shielded electrical terminal of FIG. 3 according to an embodiment of the invention mated with the corresponding shielded electrical terminal.
Figure 4A:
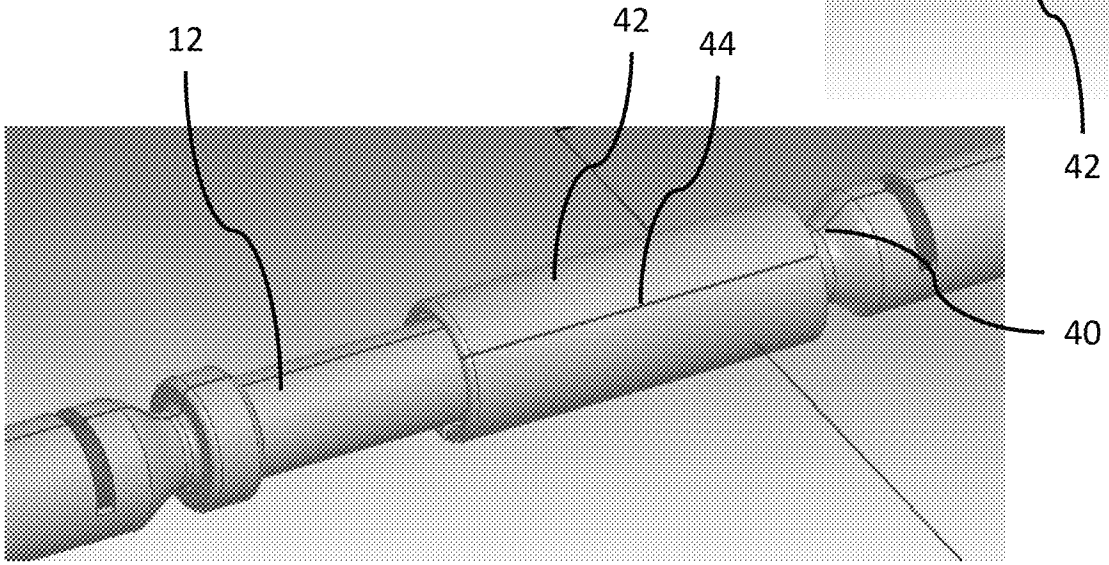
FIG. 4A is a perspective view of the shielded electrical terminal of FIG. 3 according to an embodiment of the invention mated with a corresponding shielded electrical terminal.

STEP 104, FORM A PLURALITY OF RESILIENT CONTACT SPRINGS, includes forming a plurality of resilient contact springs 30 by forming a plurality of parallel rectangular apertures or openings 32 in the inner shield preform portion 16 as shown in FIG. 2. This produces a plurality of fixed beams 34 between the openings 32. The contact springs 30 shown in FIG. 3 are formed from these fixed beams 34 shown in FIG. 2 by bending the beams into a generally arcuate shape such that they are no longer co-planar with the single plane of the terminal preform 14. The contact springs 30 are configured to physically and electrically contact the corresponding male shield terminal 12 as shown in FIGS. 4A and 4B. The contact springs 30 may be formed concurrently with the formation of the terminal preform 14 using a stamping die or other known sheet metal forming techniques.

STEP 106, FORM THE INNER SHIELD PREFORM INTO AN INNER SHIELD, includes forming the inner shield preform portion 16 into an inner shield 36 defining a generally cylindrical shield cavity 38 about a longitudinal axis X as shown in FIG. 3. The inner shield 36 may be formed using techniques well known to those skilled in the art. The shield cavity 38 is configured to receive the corresponding male shield terminal 12. The inner shield 36 has a longitudinal inner seam 40 where opposed edges of the inner shield preform portion 16 meet that is substantially parallel to the longitudinal axis X. The plurality of contact springs 30 protrude into the shield cavity 38. The formation of the plurality of contact springs 30 creates a plurality of openings 32 in a wall of the inner shield 36. After the formation of the inner shield 36, the plurality of contact springs 30 are radially evenly spaced about the longitudinal axis X.

STEP 108, FORM THE OUTER SHIELD PREFORM INTO AN OUTER SHIELD, includes forming the outer shield preform portion 18 into an outer shield 42 by folding the narrowed connecting strip 22 between the inner shield 36 and the outer shield preform portion 18 such that the outer shield preform portion 18 is folded back over at least a portion of the inner shield 36 that includes contact springs 30 and then bending the outer shield preform portion 18 into a generally cylindrical shape that covers at least the plurality of openings 32 as illustrated in FIG. 4. The inventors have discovered that covering the openings 32 around the contact springs 30 with the outer shield 42 that is integrally connected to the inner shield 36 reduces the leakage of the electrical field. The outer shield 42 has a longitudinal outer seam 44 where opposed edges of the outer shield preform portion 18 meet that is substantially parallel to the longitudinal axis X. The inventors have discovered that radially offsetting the inner seam from the outer seam further reduces the leakage of the electrical field outside of the female shield terminal 10.

While the illustrated example of the female shield terminal 10 has a cylindrical shape with a round cross section, other embodiments may be envisioned having square, rectangular, or elliptical cross sections.

Figure 5:
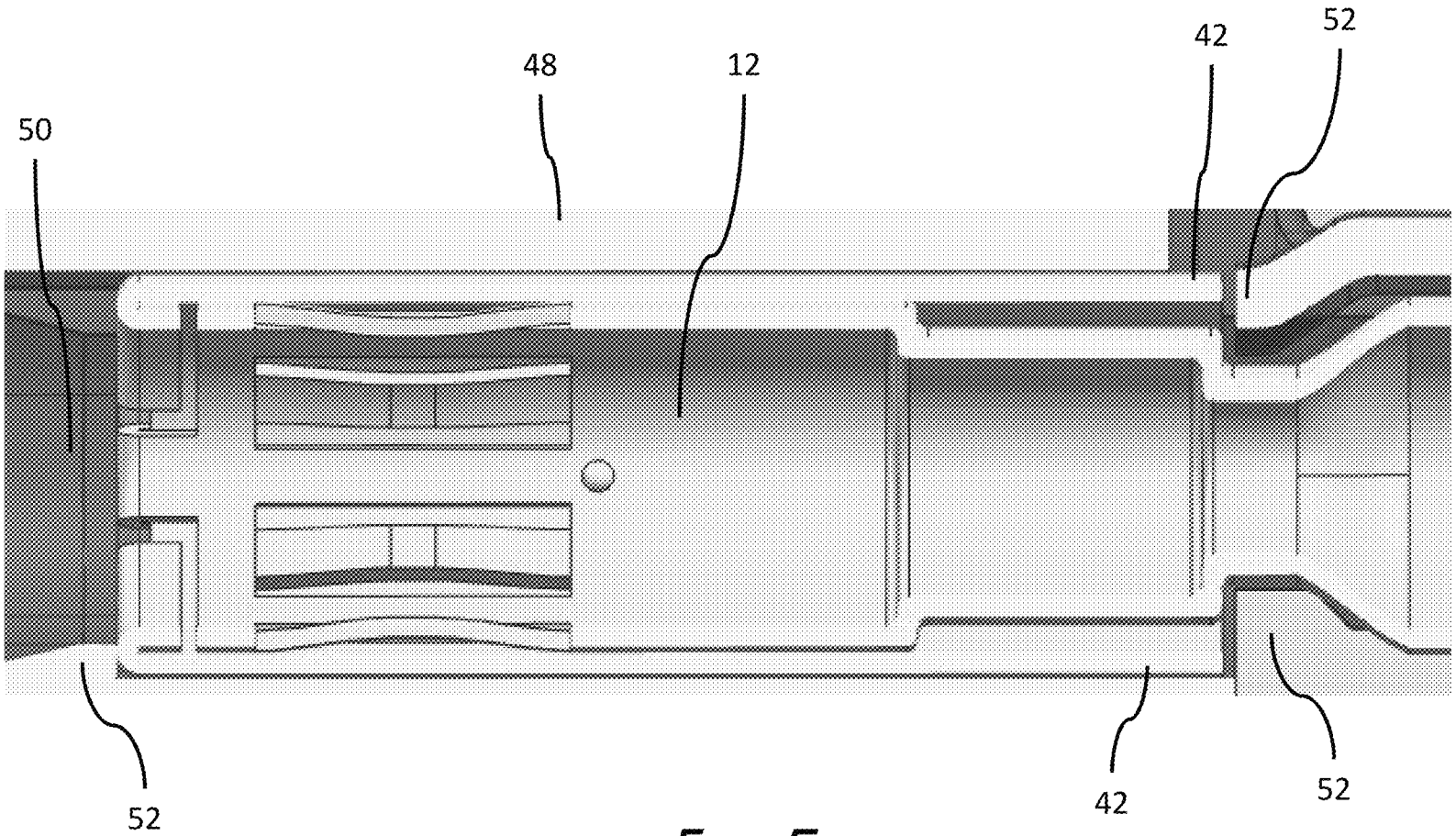
FIG. 5 is a perspective view of an electrical filed surrounding the shielded electrical terminal of FIG. 3 according to an embodiment of the invention mated with the corresponding shielded electrical terminal.

As illustrated in FIG. 5, the female shield terminal 10 is disposed within a connector body 48 having a terminal cavity 50. The inventors have also discovered that the rearward edge of the outer shield 42 interfaces with the retention features 52 in the terminal cavity 50 to more securely retain the female shield terminal 10 within the terminal cavity 50.

Accordingly a method 100 of forming a female shield terminal 10 configured to receive a corresponding male shield terminal 12 and a female shield terminal 10 formed by this method 100 is provided. The female shield terminal 10 provides the benefit of reduced leakage of the electrical field from the female shield terminal 10 resulting in improved radio frequency performance of the female shield terminal 10. The female shield terminal 10 also provides the benefits of lower manufacturing costs compared to comparable machined or cast shield terminals.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A method of forming a shielded electrical terminal configured to receive a corresponding shielded electrical terminal, comprising the steps of:

a) cutting a terminal preform from a sheet of metal defining a single plane, said terminal preform having an inner shield preform portion, an outer shield preform portion, and a connection preform portion;

b) forming a plurality of resilient rectangular contact springs by forming a plurality of parallel rectangular apertures in the inner shield preform portion, thereby producing a plurality of fixed beams between the rectangular apertures and bending the plurality of fixed beams such that they are no longer co-planar with the single plane, said plurality of contact springs are configured to contact the corresponding shielded electrical terminal, wherein the inner shield preform is disposed between the connection preform portion and the outer shield preform portion;

c) forming the inner shield preform portion into an inner shield defining a shield cavity about a longitudinal axis, said shield cavity configured to receive the corresponding shielded electrical terminal, said inner shield having an inner seam substantially parallel to the longitudinal axis, wherein the plurality of contact springs protrude into the shield cavity; and d) forming the outer shield preform portion into an outer shield by folding the outer shield preform portion over at least a portion of the inner shield.

2. The method according to claim 1, wherein the outer shield has an outer seam substantially parallel to the longitudinal axis, wherein the inner shield and the outer shield are characterized as having a generally cylindrical shape and wherein the outer seam is radially offset from the inner seam.

3. The method according to claim 1, wherein formation of the plurality of contact springs creates a plurality of openings in a wall of the inner shield and wherein the outer shield is formed to cover at least the plurality of openings.

4. The method according to claim 3, wherein the outer shield is formed to completely cover the inner shield.

5. The method according to claim 1, wherein the plurality of contact springs are formed to be evenly spaced radially about the longitudinal axis.

6. A shielded electrical terminal configured to receive a corresponding shielded electrical terminal, said shielded electrical terminal formed by a method comprising the steps of:

a) cutting a terminal preform from a sheet of metal defining a single plane, said terminal preform having an inner shield preform portion, an outer shield preform portion, and a connection preform portion;

b) forming a plurality of resilient rectangular contact springs by forming a plurality of parallel rectangular apertures in the inner shield preform portion, thereby producing a plurality of fixed beams between the rectangular apertures and bending the plurality of fixed beams such that they are no longer co-planar with the single plane, said plurality of contact springs are configured to contact the corresponding shielded electrical terminal, wherein the inner shield preform is disposed between the connection preform portion and the outer shield preform portion;

c) forming the inner shield preform portion into an inner shield defining a shield cavity about a longitudinal axis, said shield cavity configured to receive the corresponding shielded electrical terminal, said inner shield having an inner seam substantially parallel to the longitudinal axis, wherein the plurality of contact springs protrude into the shield cavity; and d) forming the outer shield preform portion into an outer shield by folding the outer shield preform portion over at least a portion of the inner shield.

7. The shielded electrical terminal according to claim 6, wherein the inner shield and the outer shield are characterized as having a generally cylindrical shape, wherein the outer shield has an outer seam substantially parallel to the longitudinal axis, and wherein the outer seam is radially offset from the inner seam.

8. The shielded electrical terminal according to claim 6, wherein formation of the plurality of contact springs creates a plurality of openings in a wall of the inner shield and wherein the outer shield covers at least the plurality of openings.

9. The shielded electrical terminal according to claim 8, wherein the outer shield completely covers the inner shield.

10. The shielded electrical terminal according to claim 6, wherein the plurality of contact springs are radially evenly spaced about the longitudinal axis.

11. A shielded electrical terminal configured to receive a corresponding shielded electrical terminal, comprising:

an inner shield defining a shield cavity about a longitudinal axis, said shield cavity configured to receive the corresponding shielded electrical terminal, said inner shield having an inner seam substantially parallel to the longitudinal axis, wherein the inner shield defines a plurality of parallel rectangular contact springs that protrude into the shield cavity, said plurality of contact springs are configured to contact the corresponding shielded electrical terminal; and an outer shield integrally connected to the inner shield by a narrowed connecting strip and covering at least a portion of the inner shield, wherein the connecting strip does not protrude beyond the outer shield.

12. The shielded electrical terminal according to claim 11, wherein the inner shield and the outer shield are characterized as having a generally cylindrical shape, wherein the outer shield has an outer seam substantially parallel to the longitudinal axis, and wherein the outer seam is radially offset from the inner seam.

13. The shielded electrical terminal according to claim 11, a wall of the inner shield defines a plurality of openings adjacent the plurality of contact springs and wherein the outer shield covers at least the plurality of openings.

14. The shielded electrical terminal according to claim 13, wherein the outer shield completely covers the inner shield.

15. The shielded electrical terminal according to claim 11, wherein the plurality of contact springs are radially evenly spaced about the longitudinal axis.

16. The shielded electrical terminal according to claim 11, further comprising:

a connector body having a terminal cavity and wherein a rearward edge of the outer shield interfaces with the retention features in the terminal cavity to retain the female shield terminal within the terminal cavity.

17. The method according to claim 1, wherein step b) further includes bending the plurality of fixed beams into a generally arcuate shape.

18. The shielded electrical terminal according to claim 6, wherein step b) further includes bending the plurality of fixed beams into a generally arcuate shape.

19. The shielded electrical terminal according to claim 11, wherein the plurality of parallel rectangular contact springs have an arcuate shape.

20. The method according to claim 1, wherein the inner shield preform portion is connected to the outer shield preform portion by a narrowed connecting strip and wherein step c) further includes bending the connecting strip such that the inner shield overlays the outer shield preform.

21. The shielded electrical terminal according to claim 20, wherein an end of the connecting strip is flush with an end of the outer shield.

22. The method according to claim 21, wherein step d) further includes bending an edge of the outer shield preform portion adjacent the connecting strip inwardly to form the end of the outer shield.

23. The shielded electrical terminal according to claim 6, wherein the inner shield preform portion is connected to the outer shield preform portion by a narrowed connecting strip and wherein step c) further includes bending the connecting strip such that the inner shield overlays the outer shield preform.

24. The shielded electrical terminal according to claim 23, wherein an end of the connecting strip is flush with an end of the outer shield.

25. The shielded electrical terminal according to claim 24, wherein step d) further includes bending an edge of the outer shield preform portion adjacent the connecting strip inwardly to form the end of the outer shield.

26. The shielded electrical terminal according to claim 11, wherein an end of the connecting strip is flush with an end of the outer shield.

27. The shielded electrical terminal according to claim 26, wherein an edge of the outer shield adjacent the connecting strip is bent inwardly to form the end of the outer shield.

28. The shielded electrical terminal according to claim 26, wherein the connection preform portion includes a pair of shield crimp wings and a pair of insulation crimp wings, wherein the shield crimp wings define a knurled pattern.

29. The shielded electrical terminal according to claim 11, wherein the shielded electrical terminal further comprises a connection portion having a pair of shield crimp wings and a pair of insulation crimp wings, wherein the shield crimp wings define a knurled pattern.

* * * * *